US010855011B2

(12) United States Patent
Stokoe et al.

(10) Patent No.: US 10,855,011 B2
(45) **Date of Patent: *Dec. 1, 2020**

(54) HIGH DENSITY ELECTRICAL CONNECTOR

(71) Applicant: Amphenol Corporation, Wallingford, CT (US)

(72) Inventors: Philip T. Stokoe, Attleboro, MA (US); Djamel Hamiroune, Nashua, NH (US)

(73) Assignee: Amphenol Corporation, Wallingford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/855,600

(22) Filed: Apr. 22, 2020

(65) Prior Publication Data

US 2020/0251841 A1 Aug. 6, 2020

Related U.S. Application Data

(63) Continuation of application No. 16/362,195, filed on Mar. 22, 2019.

(60) Provisional application No. 62/646,572, filed on Mar. 22, 2018.

(51) Int. Cl.

| | |
|---|---|
| ***H01R 13/514*** | (2006.01) |
| ***H01R 12/71*** | (2011.01) |
| ***H01R 13/6471*** | (2011.01) |
| *H01R 12/72* | (2011.01) |
| *H01R 13/6587* | (2011.01) |

(52) U.S. Cl.

CPC ..... *H01R 12/716* (2013.01); *H01R 13/6471* (2013.01); *H01R 12/724* (2013.01); *H01R 13/514* (2013.01); *H01R 13/6587* (2013.01)

(58) Field of Classification Search

CPC . H01R 13/514; H01R 13/6587; H01R 12/724

See application file for complete search history.

(56) References Cited

U.S. PATENT DOCUMENTS

| | | | | |
|---|---|---|---|---|
| 7,967,637 | B2 | 6/2011 | Fedder | |
| 8,308,512 | B2 | 11/2012 | Ritter | |
| 2015/0236451 | A1 | 8/2015 | Cartier, Jr. | |
| 2016/0308309 | A1 * | 10/2016 | Stokoe | H01R 13/6587 |
| 2017/0047692 | A1 | 2/2017 | Cartier, Jr. et al. | |
| 2018/0358751 | A1 | 12/2018 | Laurx | |

* cited by examiner

*Primary Examiner* — Tho D Ta

(74) *Attorney, Agent, or Firm* — Blank Rome LLP

(57) ABSTRACT

A connector module for an electrical connector that has at least one wafer assembly with at least one conductive member and at least one contact wafer. The contact wafer includes a plurality of contacts including at least one signal contact and at least one ground contact. Each of the contacts has a board engagement end configured to engage a printed circuit board and a mating interface end opposite thereof and configured to connect with a contact of a mating connector module. A grounding gasket receives the board engagement ends of the contacts of the wafer assembly. The grounding gasket has at least one portion in electrical contact with the ground contact of the plurality of contacts. The ground contact of the contact wafer is in electrical contact with both the conductive member and the grounding gasket, thereby defining a grounding path through the connector module to the board.

18 Claims, 14 Drawing Sheets

HIGH DENSITY ELECTRICAL CONNECTOR

RELATED APPLICATIONS

This application is a continuation application of U.S. patent application Ser. No. 16/362,195, filed on Mar. 22, 2019, which claims the benefit of U.S. Provisional Application No. 62/646,572, filed on Mar. 22, 2018. The contents of those applications are hereby incorporated by reference.

FIELD OF THE INVENTION

The present invention relates to a high density electrical connector for interconnecting printed circuit boards.

BACKGROUND OF THE INVENTION

Printed circuit boards of electronic assemblies, such as daughter cards and backplanes, are typically joined together via electrical connectors. Current electronic systems, which are smaller, faster, and functionally more complex than before, result in a significant increase in the number of circuits in a given area of an electronic system and increase in the frequencies at which the circuits operate. Current systems pass more data between printed circuit boards and require electrical connectors that are electrically capable of handling more data at higher speeds.

A need exists for a high density electrical connector that can accommodate a higher density of contacts and higher speeds while providing improved electrical performance without increasing the footprint of the connector.

SUMMARY OF THE INVENTION

Accordingly, the present invention may provide a connector module for an electrical connector that comprises at least one wafer assembly that may comprise at least one conductive member and at least one contact wafer. The contact wafer may include a plurality of contacts comprising at least one signal contact and at least one ground contact. Each of the plurality of contacts has a board engagement end configured to engage a printed circuit board and a mating interface end opposite the board engagement end that is configured to connect with a corresponding contact of a mating connector module. A grounding gasket may receive the board engagement ends of the plurality of contacts of the wafer assembly. The grounding gasket may have at least one portion in electrical contact with the one or more ground contacts of the plurality of contacts. The ground contacts of the contact wafer are in electrical contact with both the conductive member and the grounding gasket, thereby defining a grounding path through the connector module.

In a preferred embodiment, the conductive member or members and the grounding gasket are formed of a lossy material. In another embodiment, the plurality of contacts of the contact wafer comprise a plurality of signal contacts and a plurality of ground contacts; and the plurality of signal contacts are arranged in differential pairs wherein the differential pairs of the signal contacts and each of the plurality of ground contacts are positioned in an alternating arrangement in the contact wafer. In some embodiments, the plurality of contacts are supported by a mold; the signal contacts are isolated from the conductive member; the board engagement ends of the ground contacts are in electrical contact with the grounding gasket and the mating interface ends of the ground contacts are in electrical contact with the at least one conductive member; and/or the conductive member is a plate or insert positioned adjacent to and abutting a face of the contact wafer.

In certain embodiments, the grounding gasket may have a frame with a plurality of open segments, and each open segment may have a portion in electrical contact with the ground contacts; each open segment may be sized to receive one of the differential pairs of the signal contacts positioned between two of the ground contacts where each of the ground contacts is in electrical contact with the frame; each differential pair of signal contacts may be spaced from the frame; and/or the frame may include one or more tab extensions configured to engage one or more corresponding notches in the conductive members.

In other embodiments, the wafer assembly may further comprise a second conductive member such that the contact wafer is sandwiched between the conductive members; the wafer assembly may further comprise a second contact wafer such that the one conductive member is sandwiched between the contact wafers; the wafer assembly may further comprise second and third conductive members, the second conductive member may be positioned adjacent to and abutting an outer face of the at least one contact wafer and the third conductive member may be positioned adjacent to and abutting an outer face of the second contact wafer; and/or the conductive member may include a plug portion corresponding to the mating interface ends of the plurality of contacts of the wafer assembly and configured for insertion into the mating connector module.

In some embodiments, the conductive member is an insert with opposing sides, and each side has at least one ground contact engagement portion and at least one signal contact receiving portion; each side of the conductive member may have a plurality of ground contact engagement portions and a plurality of signal contact receiving portions wherein each of the ground contact engagement and signal contact receiving portions alternate with respect to one another; the plurality of ground contact engagement portions and the plurality of signal contact receiving portions on one side may be offset from the plurality of ground contact engagement portions and the plurality of signal contact receiving portions on the other side of the conductive member; the ground contact engagement portion may include a coupling element configured to engage a corresponding coupling element of the ground contact; the coupling element of the ground contact engagement portion may be a projection and the coupling element of the ground contact may be a slot sized to receive the projection; the wafer assembly may further comprise an insulative portion disposed in the signal contact receiving portion between the signal contacts and the conductive member; the insulative portion may be part of a shroud supporting the wafer assembly and the conductive member; and/or the wafer assembly may further comprise a second contact wafer, each contact wafer may have a support mold, and the conductive member may be located between the contact wafers and the support molds thereof.

In an embodiment, the board engagement ends of the plurality of contacts define solder or press-fit pins.

The present invention may also provide an electrical connector that comprises first and second connector modules adapted to engage first and second printed circuit boards, respectively, and are adapted to mate with one another. Each of the first and second connector modules may comprise, at least one wafer assembly that comprises at least one conductive member and at least one contact wafer. The contact wafer may include a plurality of contacts that comprise at least one signal contact and at least one ground contact. Each of the plurality of contacts may have a board engagement end and a mating interface end opposite the board engagement end. A first grounding gasket may receive the board engagement ends of the plurality of contacts of the first connector module. The first grounding gasket may have at least one portion in electrical contact with the ground contacts of the plurality of contacts of the first connector module. A second grounding gasket may receive the board engagement ends of the plurality of contacts of the second connector module. The second grounding gasket may have at least one portion in electrical contact with the ground contacts of the plurality of contacts of the second connector module. The ground contacts of the plurality of contacts of the first connector module may be in electrical contact with both the conductive member of the first connector module and the first grounding gasket; and the ground contacts of the plurality of contacts of the second connector module may be in electrical contact with both the conductive member of the second connector module and the second grounding gasket, thereby defining a continuous grounding path between the first and second printed circuit boards, e.g. daughter card and backplane, through the first and second connector modules.

In a preferred embodiment, the one or more conductive members of both first and second connector modules are made of a lossy material; both of the first and second grounding gaskets are made of a lossy material; the signal contacts are isolated from the conductive members; the ground contacts of the plurality of contact of the first connector module contacts the first grounding gasket and the conductive members of the first connector module; and/or the ground contacts of the second connector module contacts the ground contact of the first connector module and the at least one conductive member of the second connector module and the second grounding gasket.

In certain embodiments, each of the first and second connector modules may have a plurality of wafer assemblies that each may comprise at least one conductive member and at least one contact wafer. The contact wafer may include a plurality of contacts that comprise at least one signal contact and at least one ground contact. Each contact of the plurality of contacts may have a board engagement end and a mating interface end opposite the board engagement end; the plurality of contacts may comprise a plurality of signal contacts and a plurality of ground contacts; and/or the plurality of signal contacts may be arranged in differential pairs wherein the differential pairs of the signal contacts and each of the plurality of ground contacts are positioned in an alternating arrangement in each of the contact wafers, respectively.

In some embodiments, each wafer assembly of the first connector module includes a plug portion configured for insertion between two of the wafer assemblies of the second connector module; each of the first and second grounding gaskets has a frame with a plurality of open segments that each may have a portion in electrical contact with at least one of the ground contacts of the first and second connector modules, respectively; each open segment may be sized to receive one of the differential pairs of the signal contacts positioned between two of the ground contacts where each of the ground contacts is in electrical contact with the frame and each differential pair of signal contacts is spaced from the frame; the frame of the second grounding gasket may include one or more tab extensions configured to engage one or more corresponding notches in the conductive members of the wafer assemblies of the second connector module; and/or each the wafer assemblies may further comprise a second contact wafer such that the conductive member of each wafer assembly is sandwiched between the contact wafers of each wafer assembly.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing figures.

DETAILED DESCRIPTION OF THE EXEMPLARY EMBODIMENTS

Referring to the figures, the present invention generally relates to an electrical connector 10, such as a high density type electrical connector, with connector modules 100 and 200 configured for electrically and mechanically connecting two printed circuit boards 20 and 22, such as a daughter card and a backplane. A backplane is a printed circuit board onto which many connectors may be mounted. Conducting traces in the backplane may be electrically connected to signal conductors in the connectors so that signals may be routed between the connectors. Daughter cards may also have connectors mounted thereon. The connectors mounted on a daughter card may be plugged into the connectors mounted on the backplane. In this way, signals may be routed among the daughter cards through the backplane.

Connector modules 100 and 200 are designed to shield any signal contacts thereof, reduce signal interference, and ensure a continuous grounding path between the printed circuit boards 20 and 22 through connector modules 100 and 200. This allows for an increase in the signal density of the electrical connector 10 without increasing the size of the connector. For clarity, the present invention is described in the context of a daughter card being mounted and connected to a backplane via the electrical connector 10 of the present invention. It will be understood, however, that the connector modules 100 and 200 of the electrical connector 10 of the present invention may be used to interconnect any type of printed circuit boards.

Figure 1A:
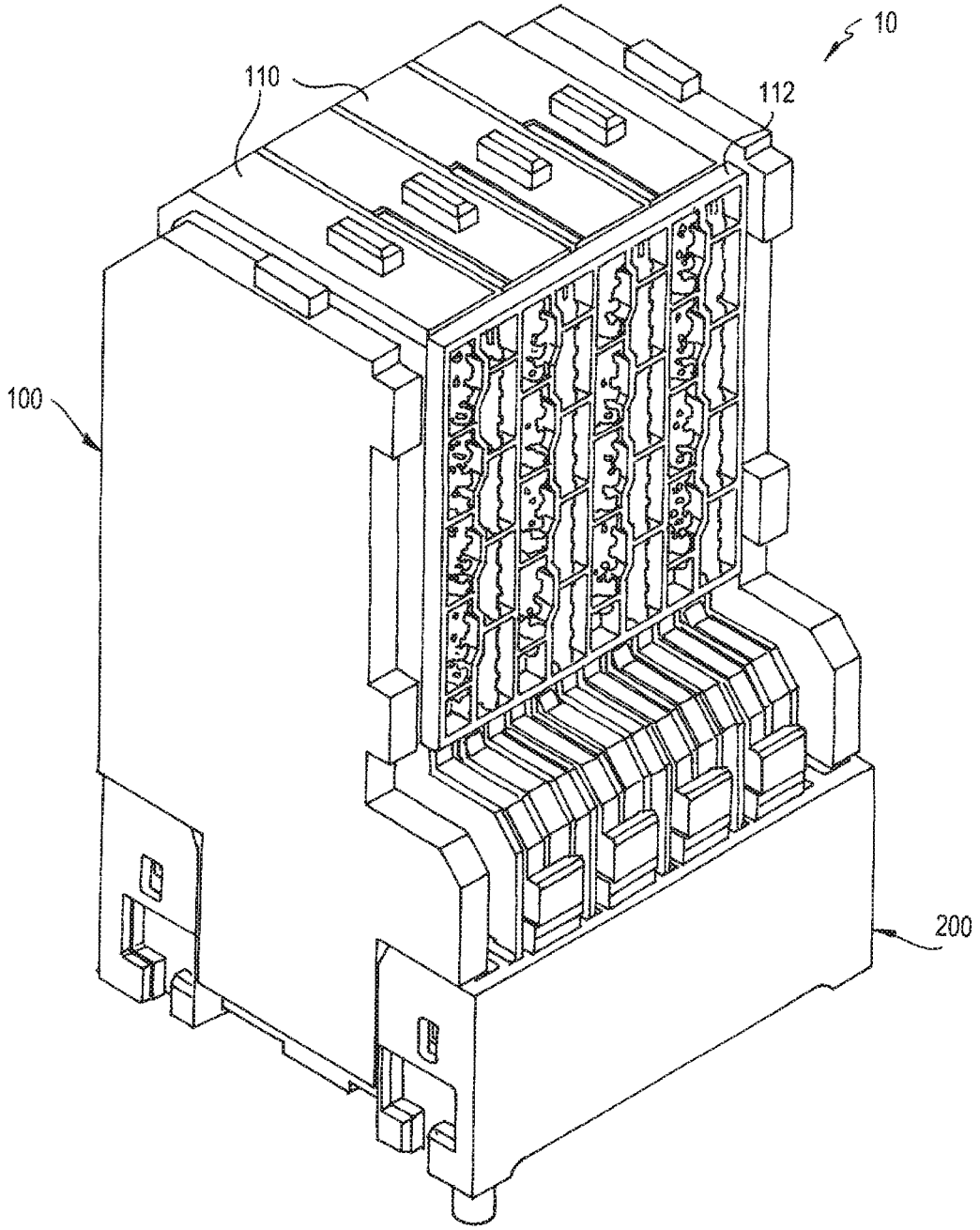
FIGS. 1A and 1B are perspective and exploded views, respectively, of a high density electrical connector according to an exemplary embodiment of the present invention.
Figure 1B:
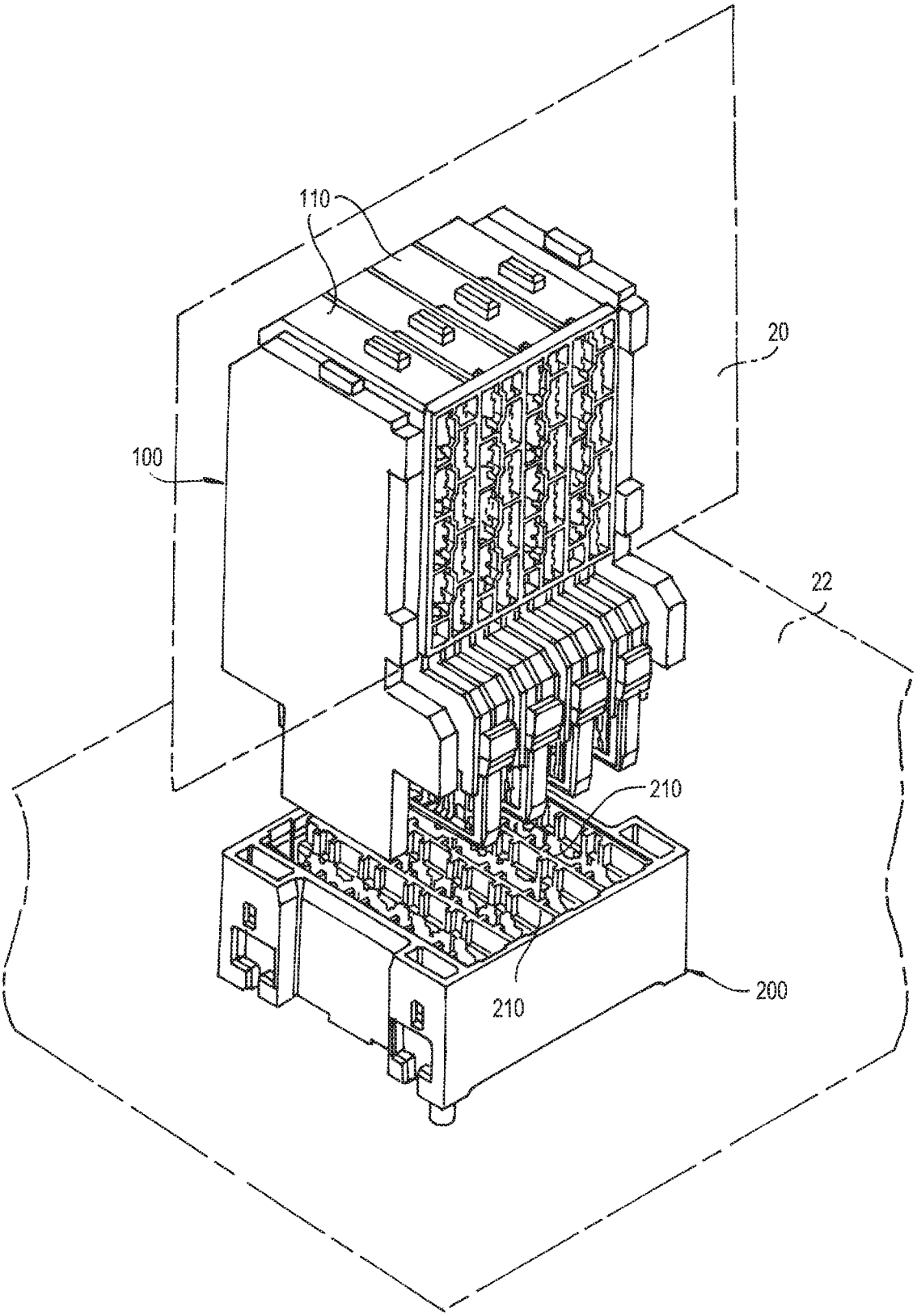
Figure 2:
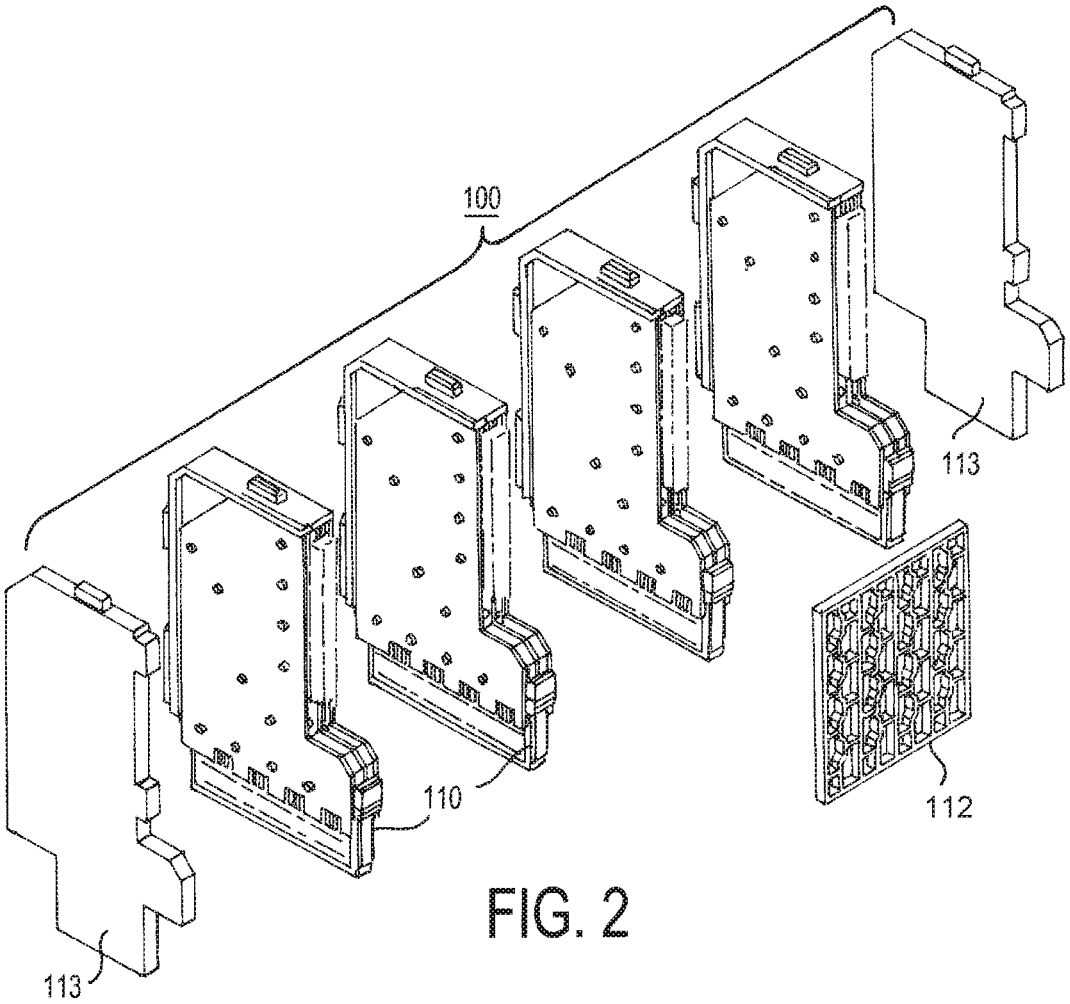
FIG. 2 is an exploded perspective view of a daughter card module of the high density electrical connector illustrated in FIGS. 1A and 1B.
Figure 3A:
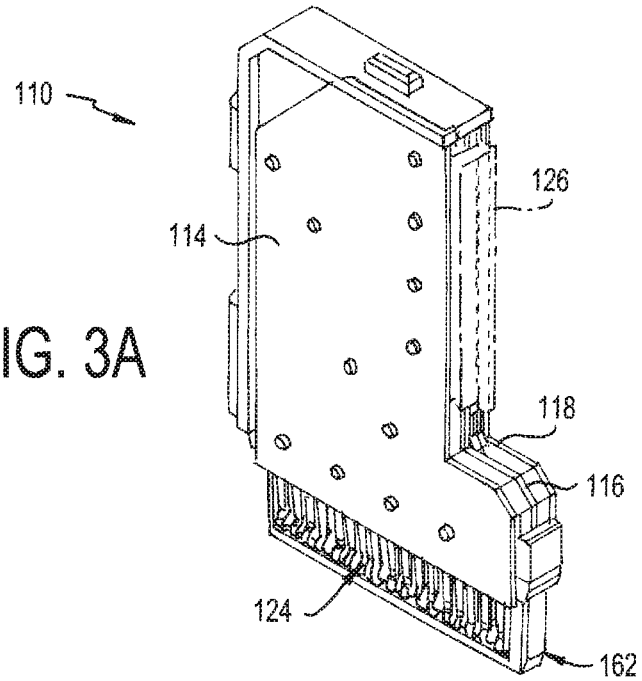
FIGS. 3A and 3B are perspective and exploded views, respectively, of a wafer assembly of the daughter card module illustrated in FIG. 2.
Figure 3B:
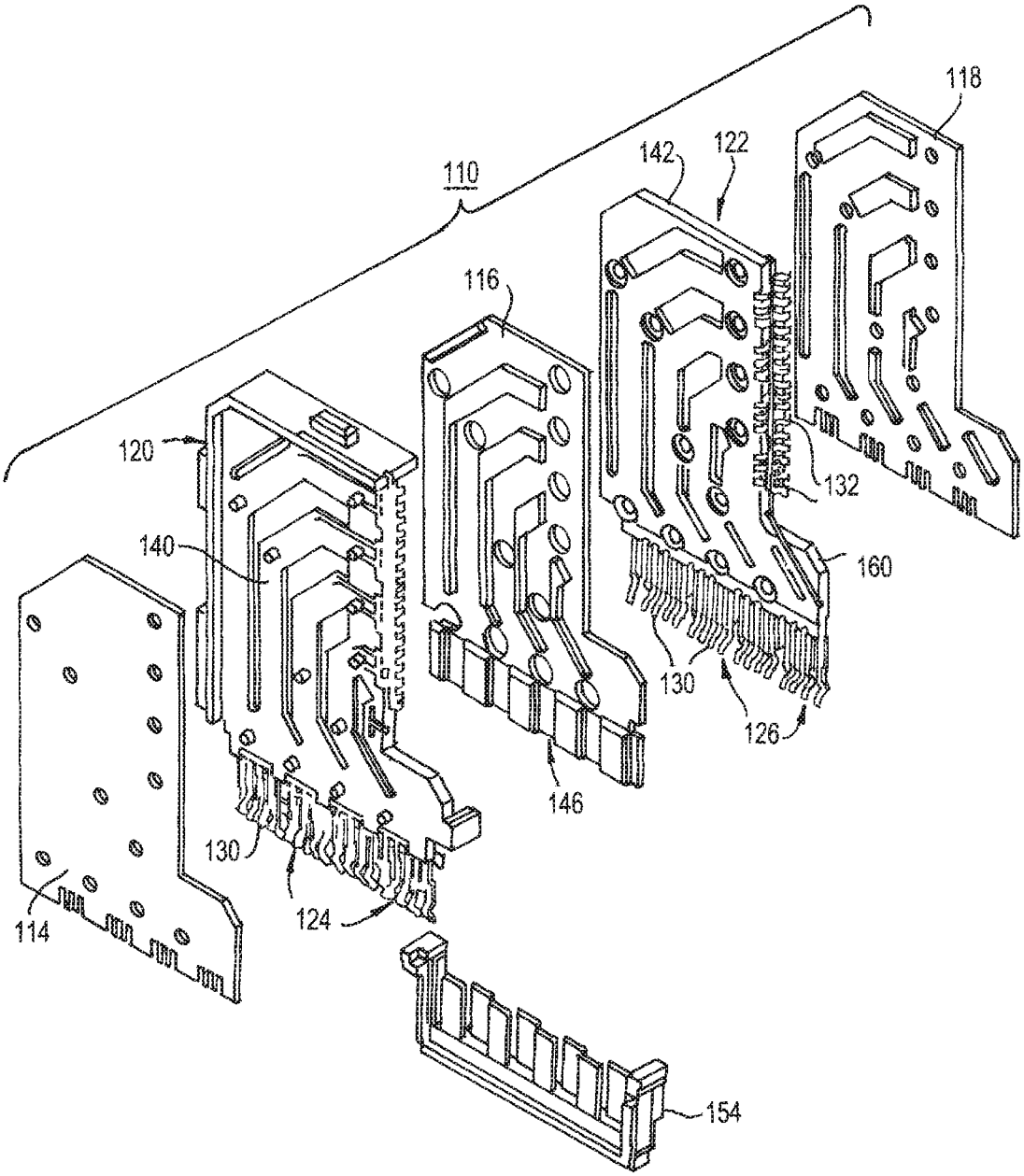
Figure 7:
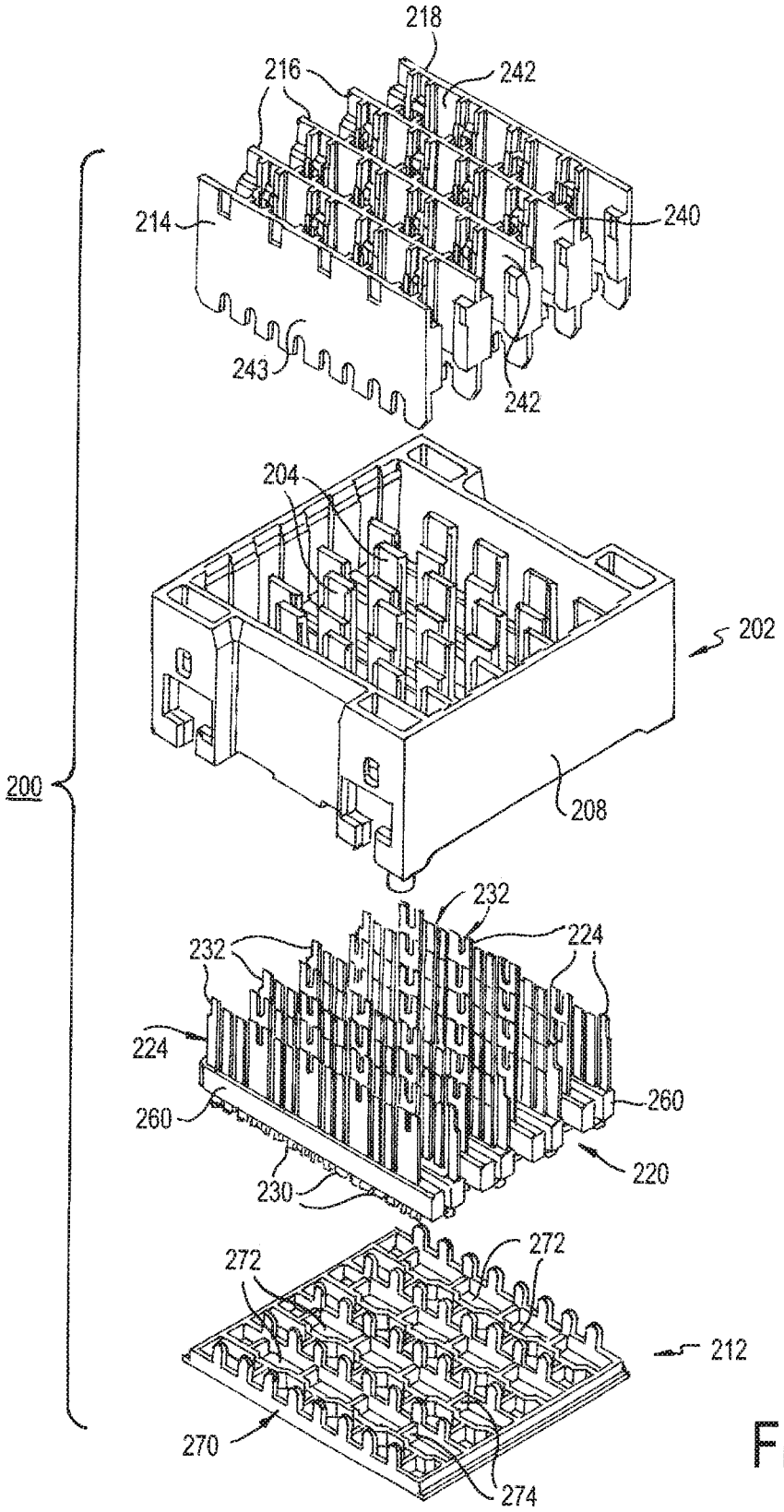
FIG. 7 is an exploded perspective view of a backplane module of the high density electrical connector illustrated in FIGS. 1A and 1B.

As seen in FIGS. 1A and 1B, connector modules 100 and 200 mate with one another to provide signal and grounding paths between the daughter card 20 and the backplane 22, respectively. Each module 100 and 200 generally includes one or more wafer assemblies 110 and 210, respectively, and a conductive grounding gasket 112 and 212, respectively, such as seen in FIGS. 2 and 7. Both modules 100 and 200 are modular in that any number of wafers assemblies 110 and 210, respectively, may be used, as desired.

In one embodiment, wafer assemblies 110 and 210 may include some lossy material as well as each gasket 112 and 212 being formed of a lossy material, to facilitate continuous and common grounding through electrical connector 10. Lossy materials are materials that electrically conduct, but with some loss, over a frequency range of interest, as described in commonly owned U.S. Published Patent Application No. 2017/0047692, the subject matter of which is herein incorporated by reference. Electrically lossy materials can be formed from lossy dielectric and/or lossy conductive materials. Electrically lossy material can be formed from material traditionally regarded as dielectric materials, such as those that have an electric loss tangent greater than approximately 0.003 in the frequency range of interest. The "electric loss tangent" is the ratio of the imaginary part to the real part of the complex electrical permittivity of the material. Electrically lossy materials can also be formed from materials that are generally thought of as conductors, but are either relatively poor conductors over the frequency range of interest, contain particles or regions that are sufficiently dispersed that they do not provide high conductivity or otherwise are prepared with properties that lead to a relatively weak bulk conductivity over the frequency range of interest.

Figure 4A:
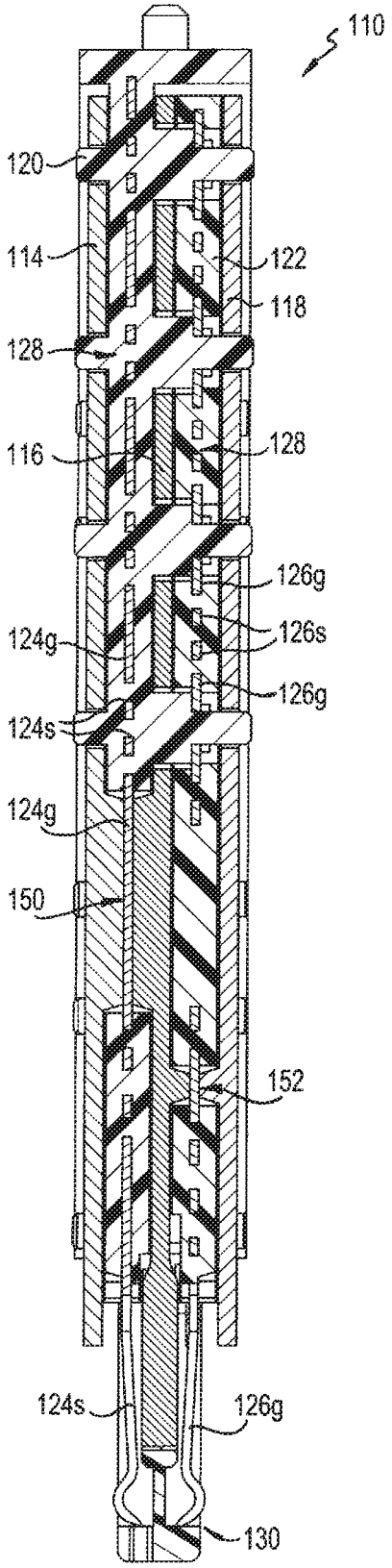
FIGS. 4A and 4B are longitudinal cross-sectional views of the wafer assembly illustrated in FIGS. 3A and 3B.
Figure 4B:
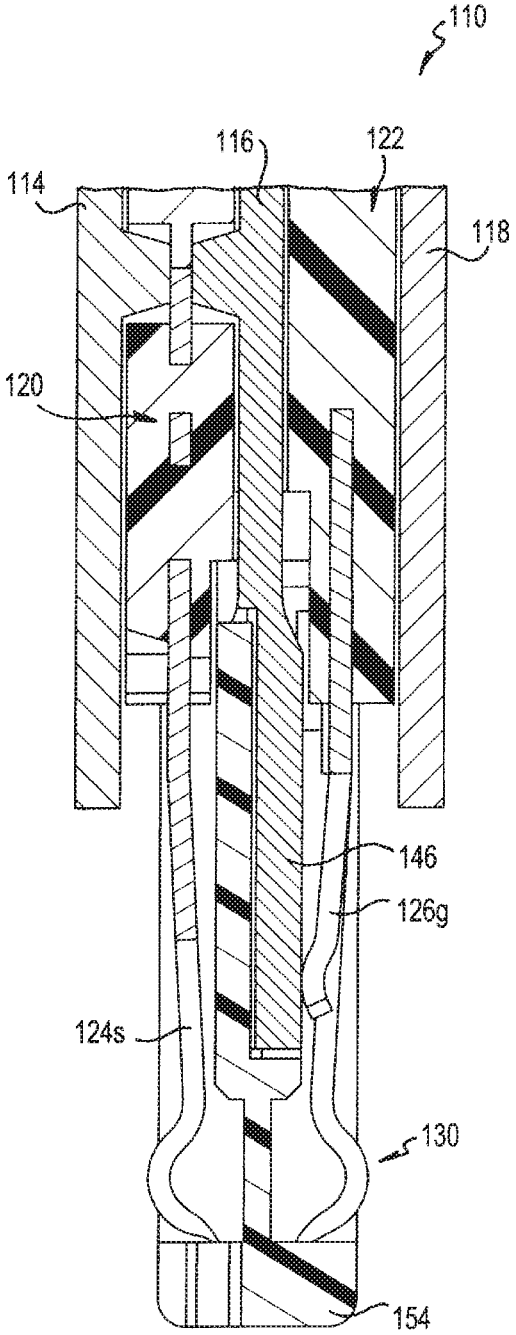
Figure 5A:
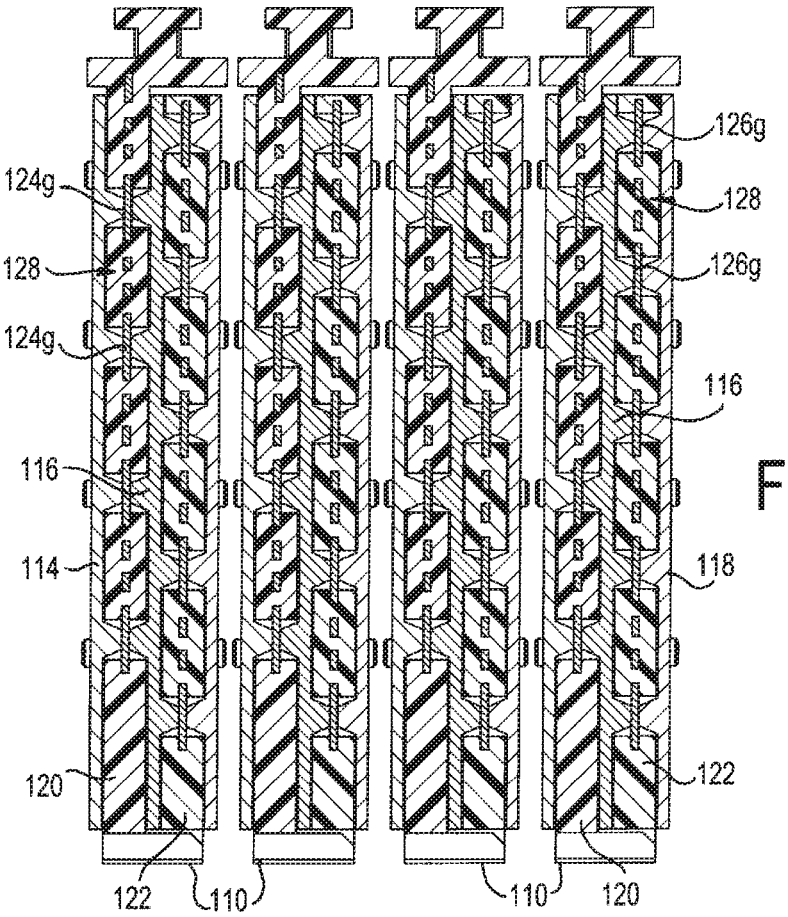
FIGS. 5A and 5B are transverse cross-sectional views of the wafer assembly illustrated in FIGS. 3A and 3B.
Figure 5B:
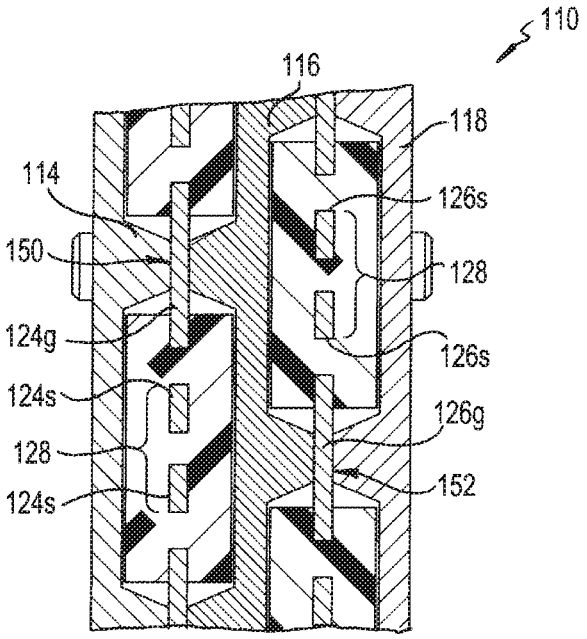

Referring to FIGS. 2-5B, daughter card module 100 generally includes one or more wafer assemblies 110, which are generally stacked against one another, and the grounding gasket that may be positioned between daughter card 20 and wafer assemblies 110. Support panels 213 may be provided at each outer end of module 100. Each wafer assembly 110 may include one or more conductive members 114, 116, and 118 and one or more contact wafers 120 and 122. Conductive members 114, 116, and 118 may be made of a lossy material. Each contact wafer 120 and 122 includes a plurality of contacts 124 and 126 that may be supported by a mold 160. In one embodiment, the contact wafers 120 and 122 are formed by insert molding an insulative material, such as plastic, (to form the mold) around a strip of the contacts 124 and 126, respectively, such as described in U.S. Published Patent Application No. 2017/0047692. Both of the plurality of contacts 124 and 126 comprise one or more ground contacts 124*g* and 126*g* and one or more signal contacts 124*s* and 126*s*. In one embodiment, the signal contacts 124*s* and 126*s* are arranged in differential pairs 128, thereby reducing crosstalk and improving electrical performance. The mold 160 of each contact wafer 120 and 122 also acts to isolate the signal contacts 124*s* and 126*s*, particularly from the ground contacts 124*g* and 126*g* and the conductive members 114, 116, and 118 to further improve electrical performance. Also, the plurality of contacts may be arranged in each contact wafer 120 and 122 such that the ground contacts 124*g* and 126*g* and the differential pairs 128 of the signal contacts 124*s* and 126*s* alternate, as best seen in FIGS. 4A and 5B. Each contact of the plurality of contacts 124 and 126 includes opposite ends, that is a board engagement end 130 configured to engage daughter card 20 and a mating interface end 132 configured to connect with contacts of connector module 200 of the backplane 22. Board engagement ends 130 may extend in a direction generally perpendicular to mating interface ends 132. Board engagement ends 130 may be, for example, solder pins or press-fit pins, for mechanically and electrically engaging daughter card 20.

Contact wafers 120 and 122 may be a plate or generally plate shaped. To form the wafer assemblies 110, the contact wafers 120 and 122 are preferably sandwiched between conductive members 114, 116, and 118, as best seen in FIG. 4A, where conductive member 116 is in the middle. Outer conductive members 114 and 118 are substantially mirror images of one another. Outer conductive member 114 is positioned generally adjacent to and abuts an outer face 140 of contact wafer 120 and outer conductive member 118 is positioned generally adjacent to and abuts an outer face 142 of contact wafer 122. Middle conductive member 116 is generally adjacent to and abuts the inner faces of contact wafers 120 and 122 and includes an end extension 146 corresponding to the mating interface ends 132 of the contacts 124 and 126.

Each conductive member 114, 116, and 118 is designed and formed to contact the ground contacts 124*g* and 126*g* of contact wafers 120 and 122, thereby establishing a grounding path through wafer assembly 110. For example, as seen in FIGS. 4A and 5B, both outer conductive member 114 and middle conductive member 116 include one or more portions 150 that contacts the ground contacts 124*g* of contact wafer 120 and outer conductive member 118 and middle conductive member 116 have one or more portions 152 that contacts the ground contacts 126*g* of contact wafer 122, thereby defining the grounding path. The mating interface end 132 of the ground contacts 124*g* and 126*g* of contact wafers 120 and 122 may also contact the end extension 146 of middle conductive member 116, as best seen in FIG. 4B. In addition, the differential pairs 128 of the signal contacts are protected and isolated from the ground contacts 124*g* and 126*g* and conductive members 114, 116, and 118 via mold 160. End extension 146 together with a nose support 154 form a plug portion 162 (FIG. 3A) of each wafer assembly 110, which is adapted to be inserted into a socket 280 (FIG. 14A) between two wafer assemblies 210 of backplane module 200.

Figure 6A:
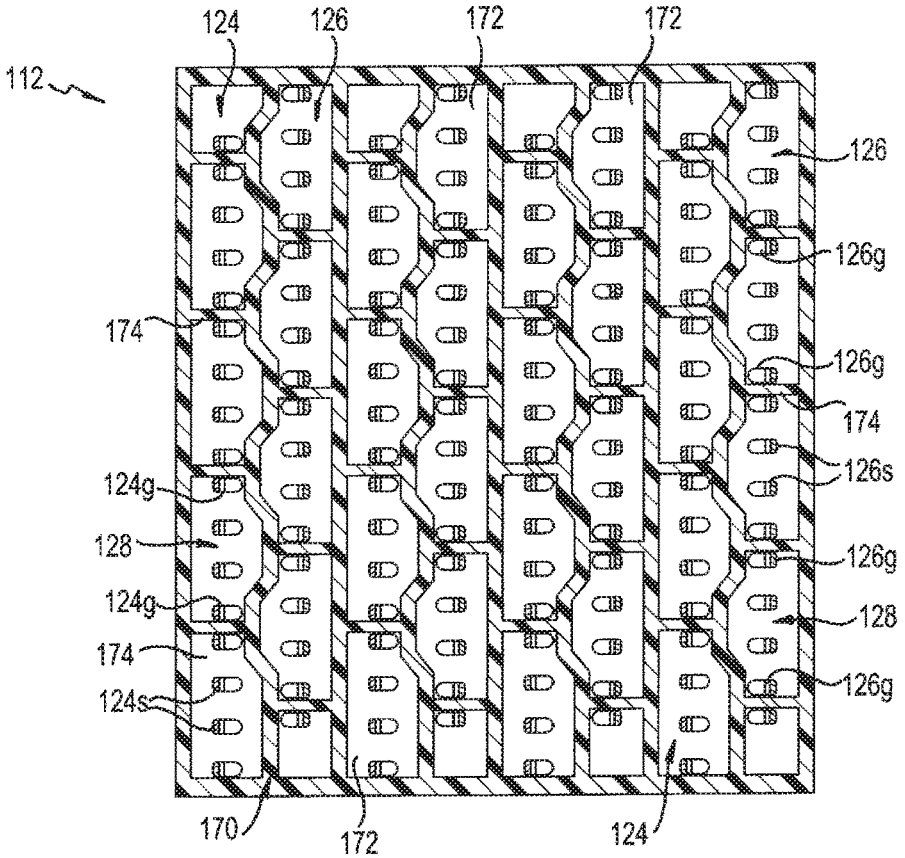
FIGS. 6A and 6B are plan and perspective views, respectively, of a grounding gasket of the high density electrical connector illustrated in FIGS. 1A and 1B.
Figure 6B:
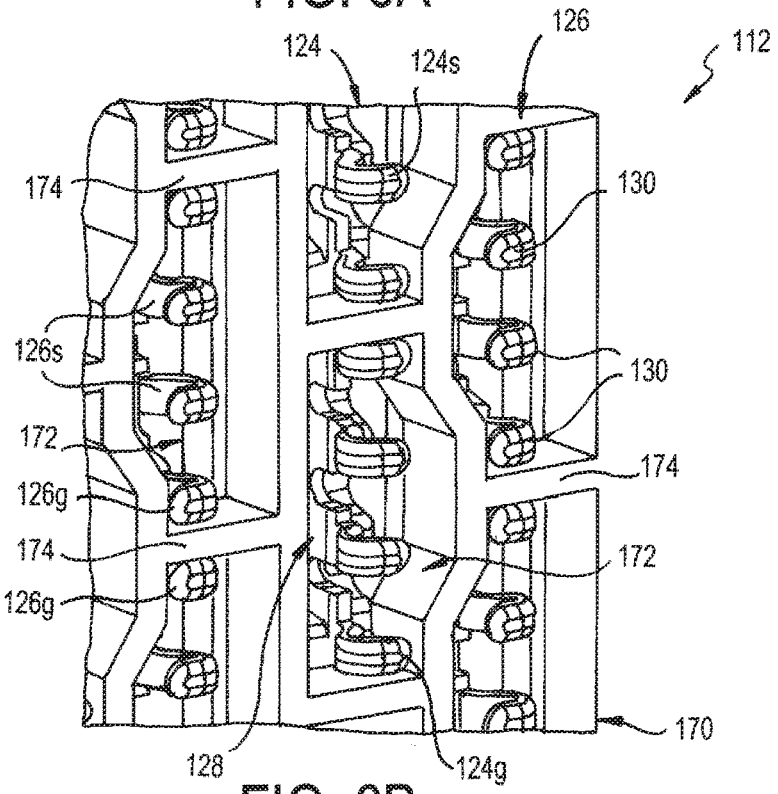

Grounding gasket 112 may be positioned between connector module 100 and daughter card 20 to provide a common ground. As seen in FIGS. 6A and 6B, gasket 112 is configured to receive the board engagement ends 130 of the plurality of contacts 124, 126. Gasket 112 includes a frame 170 that has one or more rows of open segments 172 which each receive a group of the contacts 124, 126. For example, each open segment 172 may receive one differential pair 128 of the signal contacts 124*s*, 126*s* and two ground contacts 124*g*,126*g*. In a preferred embodiment, the differential pair 128 of each open segment 172 is located between the two ground contacts 124*g*, 126*g* such that the differential pair 128 is spaced from frame 170, to isolate the differential pair 128 from frame 170, and each ground contact 124*g*, 126*g* contacts a portion 174 of frame 170, to establish a grounding path through frame 170 and maintain electrical performance.

Referring to FIGS. 7-10, backplane connector module 200 generally includes one or more wafer assemblies 210, a shroud 202 surrounding and supporting wafer assemblies 210, and the grounding gasket 212. Each wafer assembly 210 may have at least one conductive member 214, 216, or 218 and one or more contact wafers 220. Each contact wafer 220 may include a plurality of contacts 224 that may be supported by a mold 260. In one embodiment, the contact wafers 220 are formed by insert molding an insulative material, such as plastic, (to form the mold) around a strip of the contacts 224.

Figure 8A:
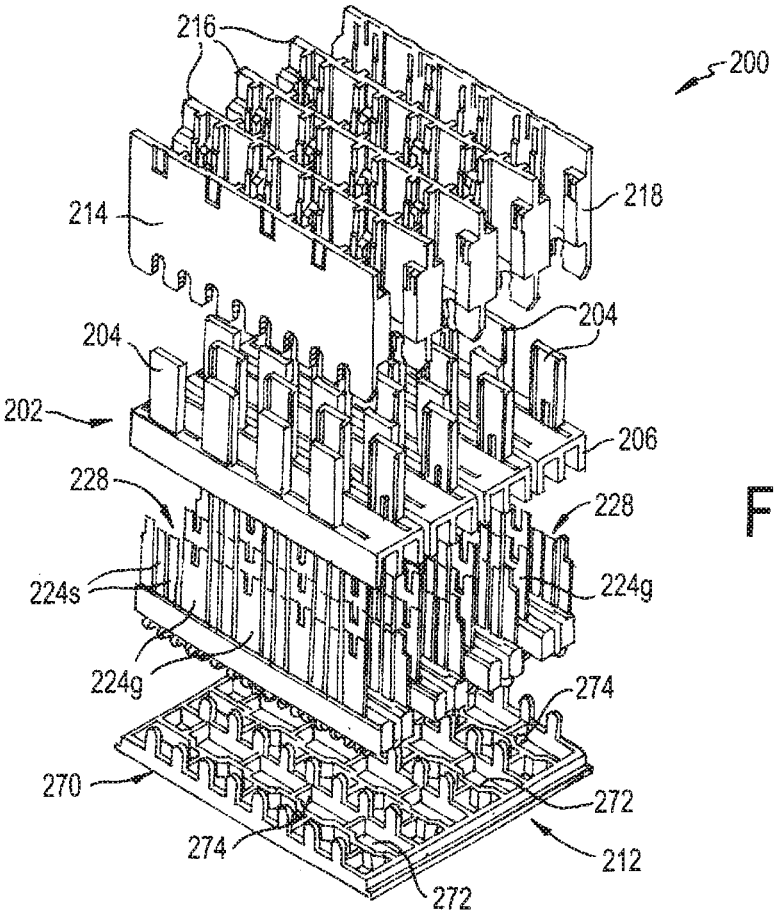
FIGS. 8A and 8B are exploded and perspective views, respectively of the backplane module illustrated in FIG. 7, showing the module without its outer shroud.
Figure 8B:
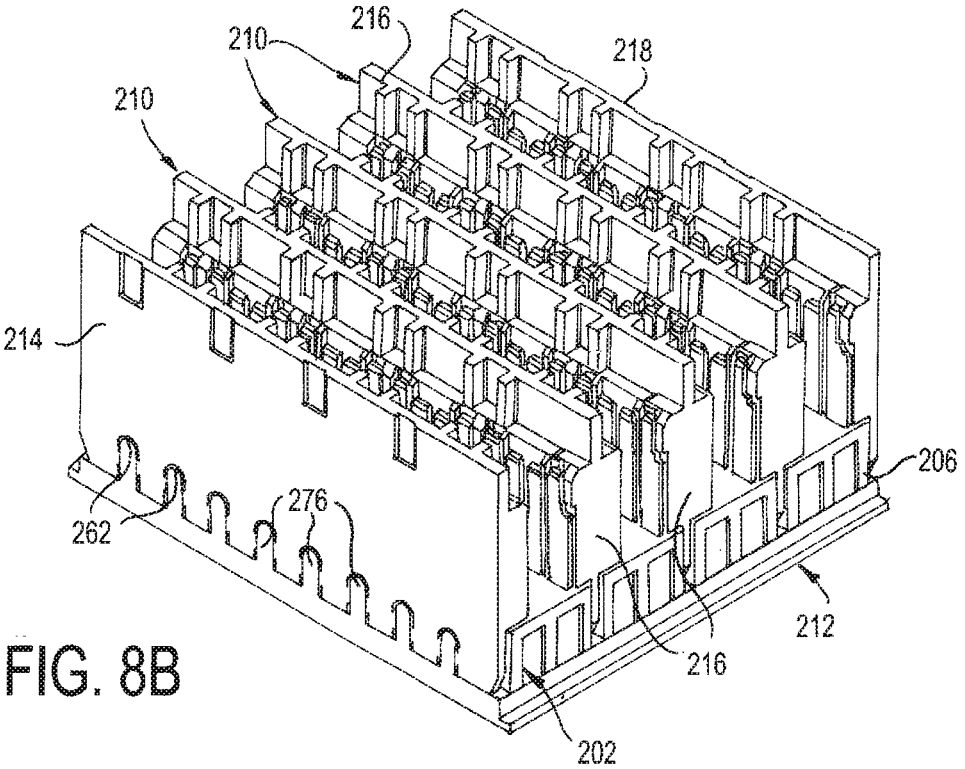
Figure 9A:
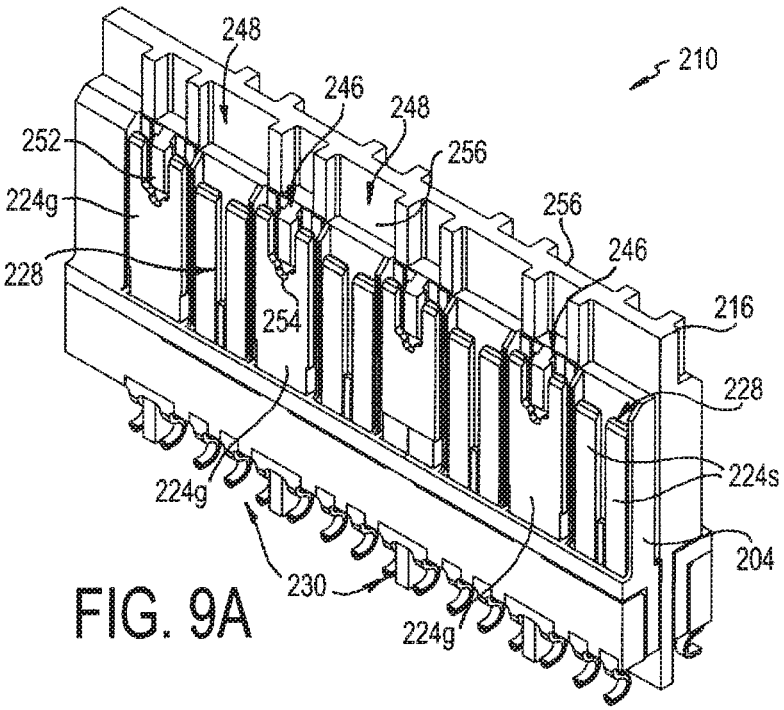
FIGS. 9A and 9B are perspective and cross-sectional views, respectively, of a wafer assembly of the backplane module illustrated in FIGS. 8A and 8B.

The plurality of contacts 224 comprise one or more ground contacts 224*g* and one or more signal contacts 224*s*. In one embodiment, the signal contacts 224*s* are arranged in differential pairs 228, thereby reducing crosstalk. Also, the plurality of contacts 224 may be arranged in each contact wafer 220 such that the ground contacts 224*g* and the differential pairs 228 of the signal contacts 224*s* alternate, as best seen in FIGS. 8A and 9A. Each contact of the plurality of contacts 224 includes opposite ends, that is a board engagement end 230 configured to engage backplane 22 and a mating interface end 232 configured to connect with daughter card connector module 100. Board engagement ends 230 may be, for example, solder pins or press-fit pins, for mechanically and electrically engaging backplane 22. Mold 260 of each contact wafer 220 may be formed near the board engagement ends 230 such that the ends 230 are exposed to engage the backplane 22.

Figure 9B:
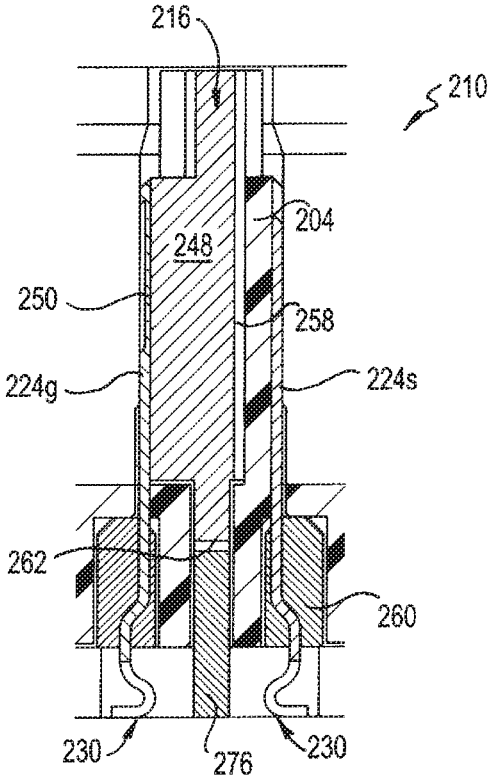
Figure 11A:
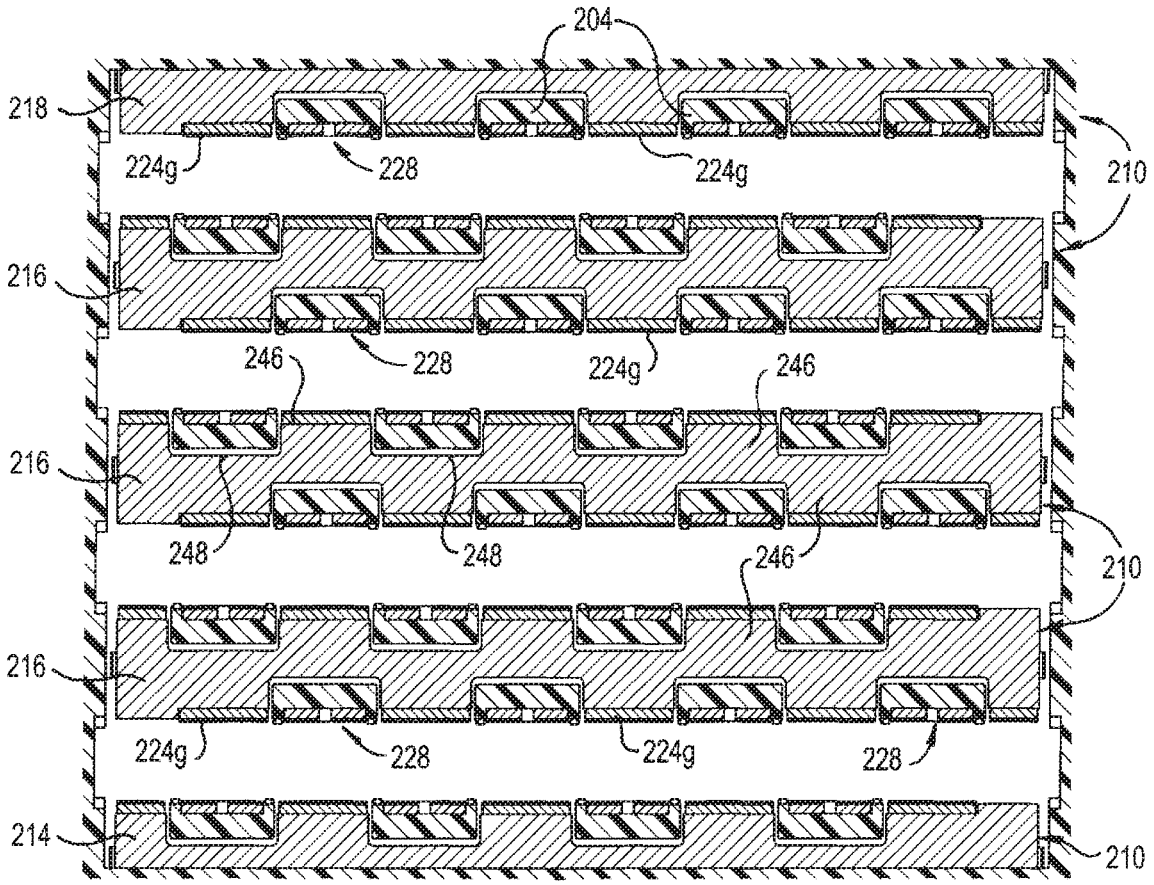
FIGS. 11A and 11B are transverse cross-sectional views of the wafer assemblies illustrated in FIGS. 8A and 8B.
Figure 11B:
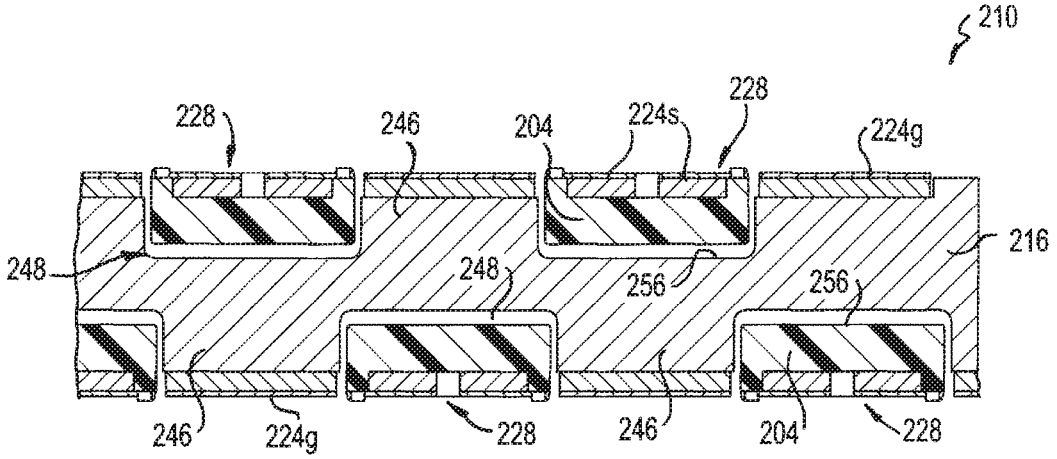

As seen in FIGS. 9A and 9B, each wafer assembly 210 may include at least one of the conductive members 214, 216, or 218 (conductive member 216 being shown in FIGS. 9A and 9B) inserted between two of the contact wafers 220. Conductive members 214, 216, and 218 may be made of a lossy material. Middle conductive members 216 are substantially the same and are generally positioned between outer conductive members 214 and 218 in module 200, as seen in FIG. 8A. Outer conductive members 214 and 218 are similar to conductive members 216, except they are trimmed to generally accommodate the shroud 202. That is, outer conductive members 214 and 218 may be about half of one middle conductive member 216. Outer conductive members 214 and 218 are also substantially mirror images of one another Each middle conductive member 216 has opposing sides 240 and 242 and each side 240 and 242 has one or more ground engagement portions 246 and one or more signal contact receiving portions 248. Each outer conductive member 214 and 218 has one of the sides 240 or 242, respectively, similar to middle conductive member 216 and an opposite substantially flat side 243 that rests against an inner surface of shroud 202. The ground engagement portions 246 and the signal contact receiving portions 248 may alternate along each side 240 and 242 to accommodate the alternating arrangement of the ground contacts 224*g* and signal contacts 224*s* of the contact wafers 220. In a preferred embodiment, ground engagement portions 246 and signal contact receiving portions 248 of one side 240 of conductive member 216 are offset from ground engagement portions 246 and signal contact receiving portions 248 of the other side 242, as best seen in FIG. 11B. Each ground engagement portion 246 may have an engagement surface 250 that generally abuts and contacts the respective ground contact 224*g* and a coupling element 252 on or near engagement surface 250 that engages a corresponding coupling element 254 of the ground contact 224*g*. For example, coupling element 252 may be a dovetail type projection and coupling element 254 may be a slot sized to receive the dovetail type projection, or vice versa, as best seen in FIG. 9A. Each signal contact receiving portion 248 defines a recessed area 256 in the side of the conductive member. The recessed area 256 is sized to receive an insulative portion 204 (FIG. 8A) of the shroud 202 such that the insulative portion 204 is sandwiched between the respective differential signal pair 228 of contact wafer 220 and the outer surface 258 of the conductive member's side 240 or 242. This insulative portion 204 helps to isolate the signal pairs 228, particularly from the conductive member. Each insulative portion 204 may be a tongue extending from a base 206 located inside an outer wall 208 of shroud 202, as best seen in FIG. 8A. The tongues 204 may be positioned in an offset arrangement such that each tongue 204 is received in a respective recessed area 256 of signal contact receiving portion 248 of each wafer assembly 210.

Figure 10:
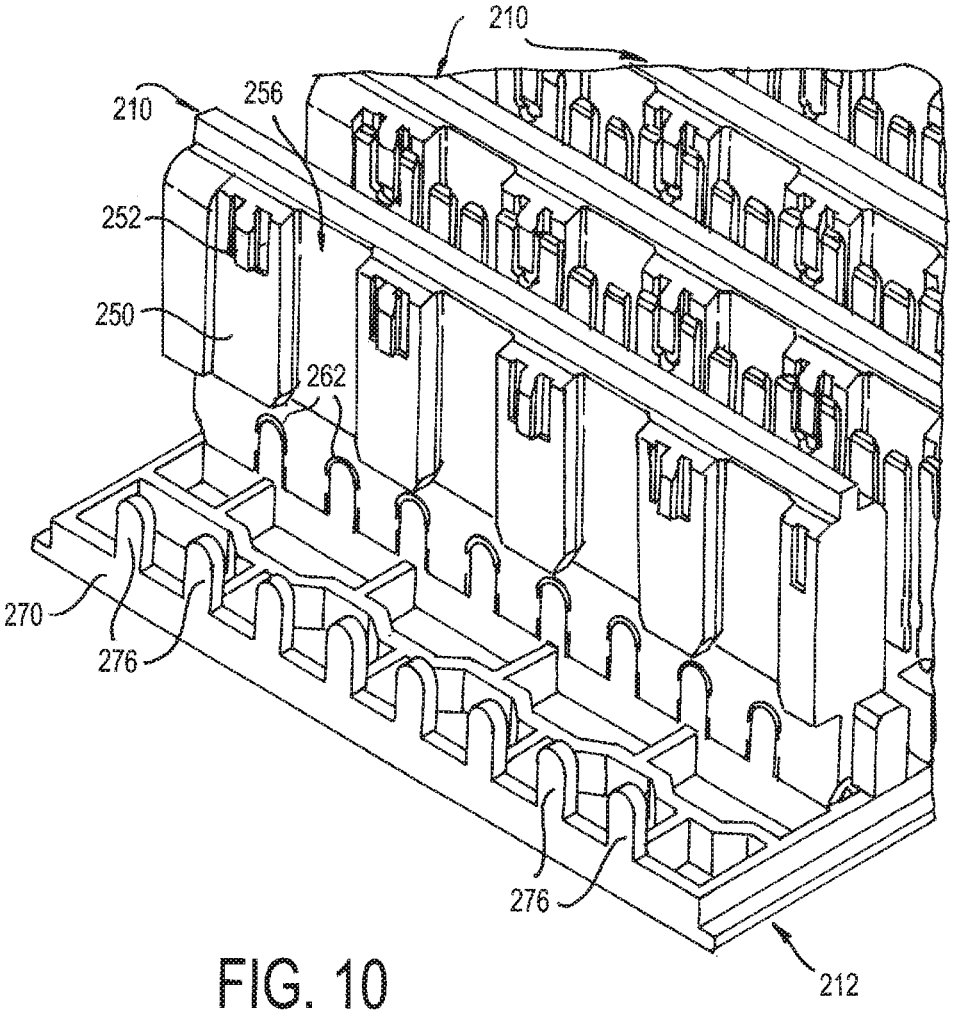
FIG. 10 is a partial perspective view of the wafer assemblies illustrated in FIGS. 8A and 8B mounted to a grounding gasket.

Each conductive member 214, 216, and 218 is designed and formed to contact the ground contacts 224*g* of contact wafers 220, thereby establishing a grounding path through wafer assembly 210. For example, as seen in FIG. 9B, each engagement surface 250 of the ground engagement portions 246 of the conductive members contacts a corresponding surface of the respective ground contact 224 creating an electrical connection therebetween. Also, each conductive member 214, 216, and 218 may include one or more notches 262 adapted to connect with grounding gasket 212, as best seen in FIG. 10.

Grounding gasket 212 may be positioned between connector module 200 and backplane 22 to provide a common ground. Similar to gasket 112 of daughter card module 100, gasket 112 is configured to receive the board engagement ends 230 of the plurality of contacts 224. Gasket 212 includes a frame 270 that has one or more rows of open segments 272 which each receive a group of the contacts 224. For example, each open segment 272 may receive one differential signal pair 228 and two ground contacts 224*g*. In a preferred embodiment, the differential pair 228 of each open segment 272 is located between the two ground contacts 224*g* such that the differential pair 228 is spaced from frame 270, to isolate the differential pair 228 from frame 270, and each ground contact 224 contacts a portion 274 of frame 270, to establish a grounding path through frame 270. Frame 270 may also have tab extensions 276 sized to engage the corresponding notches 262 of the conductive members of the wafer assemblies 210, thereby establishing another grounding path through module 200. In one embodiment, tab extensions 276 may be arranged in rows, as seen in FIGS. 7 and 8A, which correspond to the positioning of the notches 262 in the wafer assemblies 210.

Figure 12:
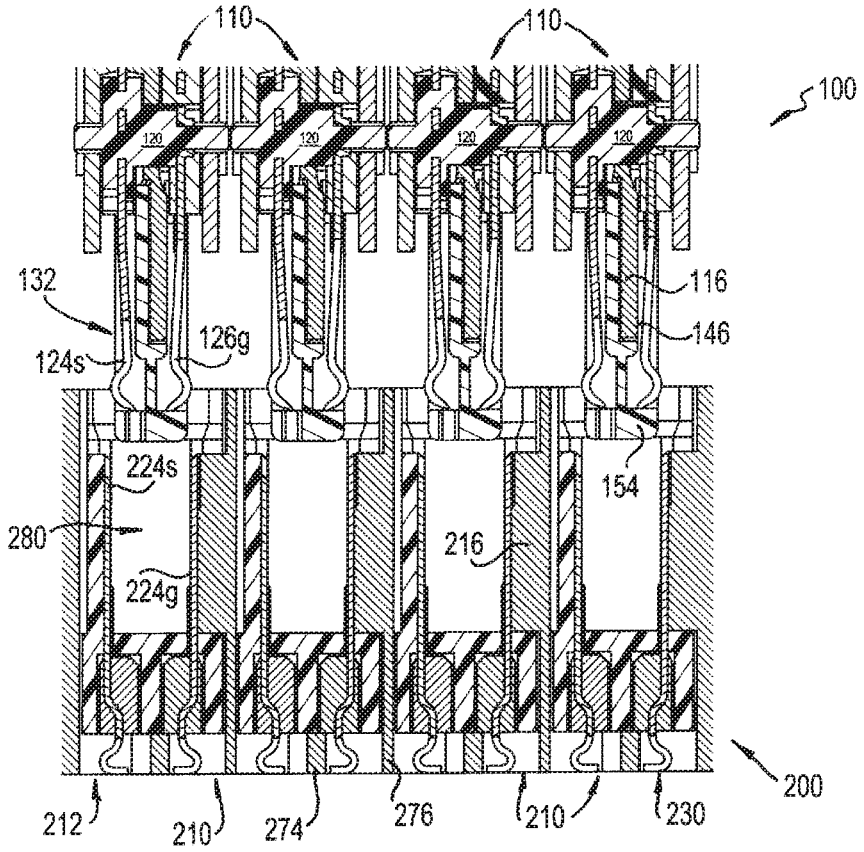
FIG. 12 is an exploded longitudinal cross-sectional view of the daughter card and backplane modules being mated in accordance with an exemplary embodiment of the present invention.
Figure 13:
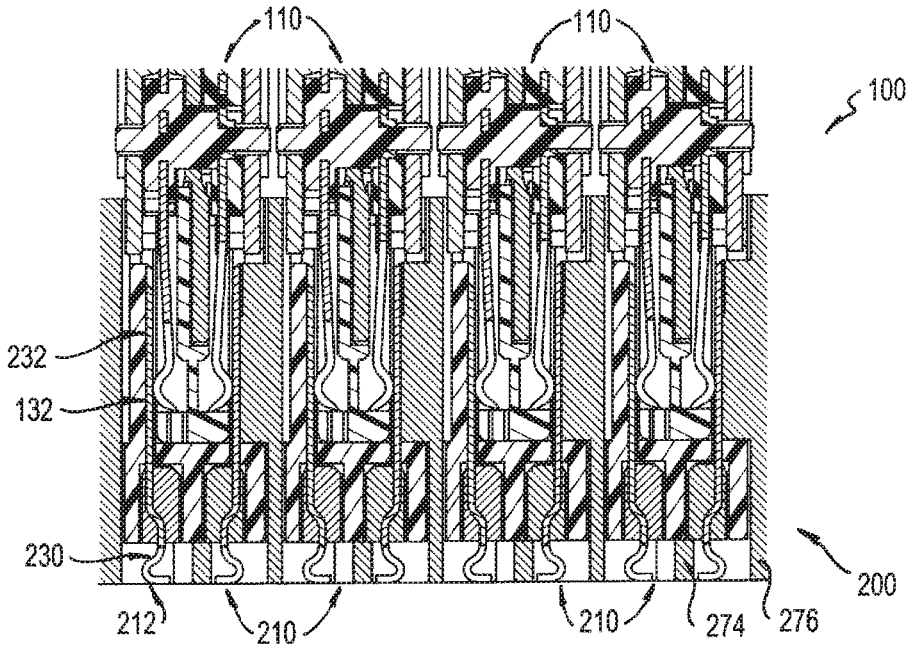
FIG. 13 is a view similar to FIG. 13, except showing the daughter card and backplane modules mated.
Figure 14A:
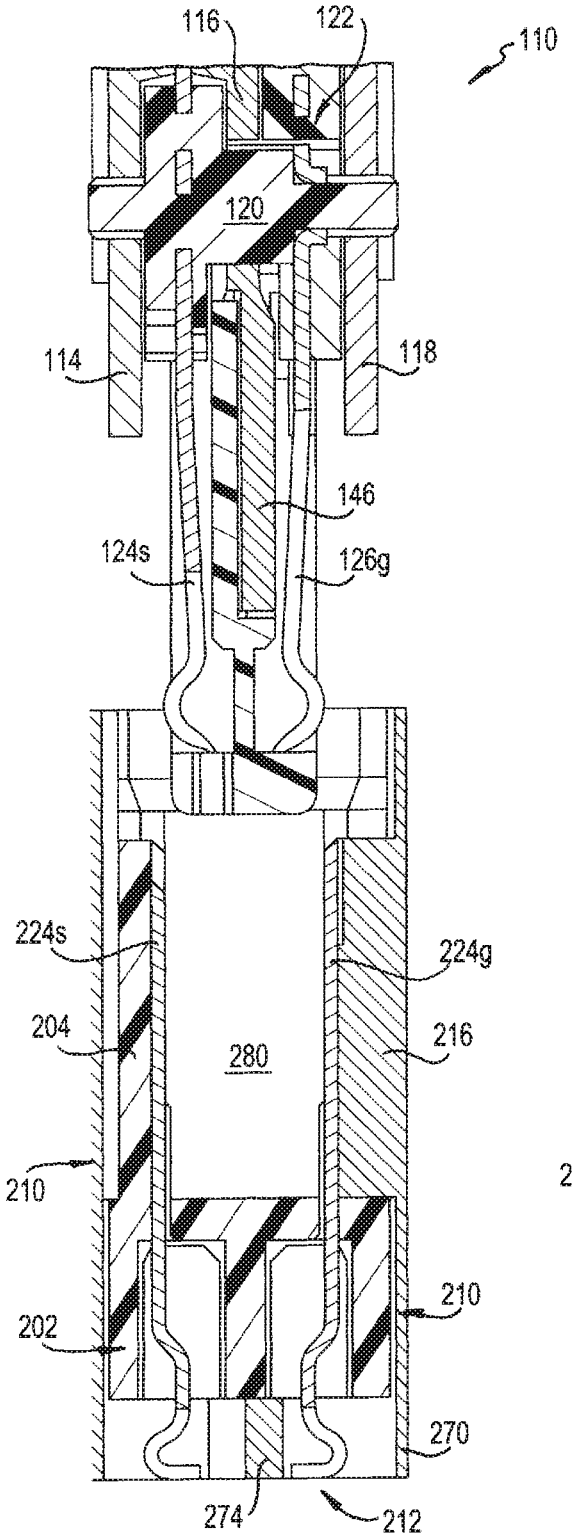
FIGS. 14A and 14B are partial perspective views of FIGS. 12 and 13, respectively, showing a wafer assembly of the daughter card module being inserted into and mated with a socket of the backplane module.
Figure 14B:
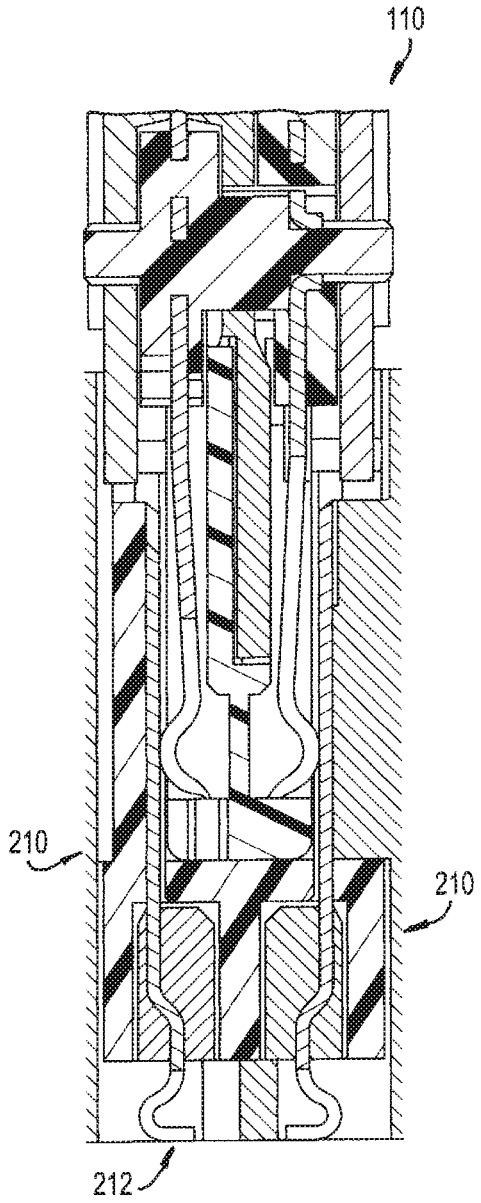

When modules 100 and 200 are mated, signal paths are established between daughter card 20 and backplane 22 and grounding gaskets 112 and 212 ensure a common ground through both modules 100 and 200. As seen in FIGS. 12 and 13, each end extension 146 together with a nose support 154 (forming plug portion 162) of the wafer assemblies 110 of daughter card module 100 may be inserted into respective sockets 280 of backplane module 200 created between the wafer assemblies 220 of module 200. When inserted, the mating interface ends 132 of the ground contacts 124*g*, 126*g* and the signal contacts 124*s*, 126*s*, respectively, of each wafer assembly 110 engages and contacts the corresponding mating interface ends 232 of the ground contacts 224*g* and signal contacts 224*s*, respectively, of wafer assemblies 220, as seen in FIGS. 14A and 14B, to establish signal and ground connections between the modules 100 and 200. Ground contacts 124*g*, 126*g* of module 100 are in electrical contact with the conductive members 114, 116, or 118 of wafer assemblies 110 and with the grounding gasket 112; and ground contacts 224*g* of module 200 are in electrical contact with the conductive members 214, 216, or 218 of wafer assemblies 220 and with grounding gasket 212, thereby defining a continuous grounding path between the daughter card 20 and the backplane 22 through the connector modules 100 and 200.

While particular embodiments have been chosen to illustrate the invention, it will be understood by those skilled in the art that various changes and modifications can be made therein without departing from the scope of the invention as defined in the appended claims.

What is claimed is:

1. A connector module for an electrical connector, comprising:

at least one wafer assembly, the wafer assembly comprising at least one conductive member and at least one contact wafer, the at least one contact wafer including, a plurality of contacts comprising at least one signal contact and at least one ground contact, each of the plurality of contacts having a board engagement end configured to engage a printed circuit board and a mating interface end opposite the board engagement end and configured to connect with a contact of a mating connector module; and a grounding gasket receiving the board engagement ends of the plurality of contacts of the at least one wafer assembly, the grounding gasket having at least one portion in electrical contact with the at least one ground contact of the plurality of contacts, wherein the at least one ground contact of the contact wafer is in electrical contact with both the at least one conductive member and the grounding gasket, thereby defining a grounding path through the connector module, wherein the plurality of contacts of the at least one contact wafer comprise a plurality of signal contacts and a plurality of ground contacts, and the plurality of signal contacts are arranged in differential pairs wherein the differential pairs of the signal contacts and each of the plurality of ground contacts are positioned in an alternating arrangement in the at least one contact wafer, wherein the grounding gasket has a frame with a plurality of open segments, each open segment has a portion in electrical contact with at least one of the ground contacts, and each open segment is sized to receive one of the differential pairs of the signal contacts positioned between two of the ground contacts where each of the ground contacts is in electrical contact with the frame.

2. The connector module of claim 1, wherein each of the at least one conductive member and the grounding gasket is formed of a lossy material.

3. The connector module of claim 1, wherein the plurality of contacts are supported by a mold.

4. The connector module of claim 1, wherein the signal contacts are isolated from the at least one conductive member.

5. The connector module of claim 1, wherein the board engagement ends of the ground contacts are in electrical contact with the grounding gasket and the mating interface ends of the ground contacts are in electrical contact with the at least one conductive member.

6. The connector module of claim 1, wherein the at least one conductive member is a plate or insert positioned adjacent to and abutting a face of the at least one contact wafer.

7. The connector module of claim 1, wherein each differential pair of signal contacts is spaced from the frame.

8. The connector module of claim 1, wherein the frame includes one or more tab extensions configured to engage one or more corresponding notches in the at least one conductive member.

9. The connector module of claim 1, wherein the at least one wafer assembly further comprising a second conductive member such that the at least one contact wafer is sandwiched between the conductive members.

10. The connector module of claim 1, wherein the at least one wafer assembly further comprising a second contact wafer such that the at least one conductive member is sandwiched between the contact wafers.

11. The connector module of claim 10, wherein the at least one wafer assembly further comprises a second and third conductive members, the second conductive member being positioned adjacent to and abutting an outer face of the at least one contact wafer and the third conductive member being positioned adjacent to and abutting an outer face of the second contact wafer.

12. The connector module of claim 1, wherein the at least one conductive member is an insert having opposing sides, and each side has at least one ground contact engagement portion and at least one signal contact receiving portion.

13. The connector module of claim 12, wherein each side of the at least one conductive member has a plurality of ground contact engagement portions and a plurality of signal contact receiving portions wherein each of the ground contact engagement and signal contact receiving portions alternate with respect to one another.

14. The connector module of claim 13, wherein the plurality of ground contact engagement portions and the plurality of signal contact receiving portions on one side are offset from the plurality of ground contact engagement portions and the plurality of signal contact receiving portions on the other side of the at least one conductive member.

15. A connector module for an electrical connector, comprising:

at least one wafer assembly, the wafer assembly comprising at least one conductive member and at least one contact wafer, the at least one contact wafer including, a plurality of contacts comprising at least one signal contact and at least one ground contact, each of the plurality of contacts having a board engagement end configured to engage a printed circuit board and a mating interface end opposite the board engagement end and configured to connect with a contact of a mating connector module; and a grounding gasket receiving the board engagement ends of the plurality of contacts of the at least one wafer assembly, the grounding gasket having at least one portion in electrical contact with the at least one ground contact of the plurality of contacts, wherein the at least one ground contact of the contact wafer is in electrical contact with both the at least one conductive member and the grounding gasket, thereby defining a grounding path through the connector module, wherein the plurality of contacts of the at least one contact wafer comprise a plurality of signal contacts and a plurality of ground contacts; and the plurality of signal contacts are arranged in differential pairs wherein the differential pairs of the signal contacts and each of the plurality of ground contacts are positioned in an alternating arrangement in the at least one contact wafer, wherein the at least one conductive member includes a plug portion corresponding to the mating interface ends of the plurality of contacts of the at least one wafer assembly and configured for insertion into the mating connector module.

16. A connector module for an electrical connector, comprising:

at least one wafer assembly, the wafer assembly comprising at least one conductive member and at least one contact wafer, the at least one contact wafer including, a plurality of contacts comprising at least one signal contact and at least one ground contact, each of the plurality of contacts having a board engagement end configured to engage a printed circuit board and a mating interface end opposite the board engagement end and configured to connect with a contact of a mating connector module; and a grounding gasket receiving the board engagement ends of the plurality of contacts of the at least one wafer assembly, the grounding gasket having at least one portion in electrical contact with the at least one ground contact of the plurality of contacts, wherein the at least one ground contact of the contact wafer is in electrical contact with both the at least one conductive member and the grounding gasket, thereby defining a grounding path through the connector module, wherein the plurality of contacts of the at least one contact wafer comprise a plurality of signal contacts and a plurality of ground contacts; and the plurality of signal contacts are arranged in differential pairs wherein the differential pairs of the signal contacts and each of the plurality of ground contacts are positioned in an alternating arrangement in the at least one contact wafer, wherein the at least one conductive member is an insert having opposing sides, and each side has at least one ground contact engagement portion and at least one signal contact receiving portion, wherein the ground contact engagement portion includes a coupling element configured to engage a corresponding coupling element of the ground contact.

17. The connector module of claim 16, wherein the coupling element of the ground contact engagement portion includes a projection and the coupling element of the ground contact is a slot sized to receive the projection.

18. A connector module for an electrical connector, comprising:

at least one wafer assembly, the wafer assembly comprising at least one conductive member and at least one contact wafer, the at least one contact wafer including, a plurality of contacts comprising at least one signal contact and at least one ground contact, each of the plurality of contacts having a board engagement end configured to engage a printed circuit board and a mating interface end opposite the board engagement end and configured to connect with a contact of a mating connector module; and a grounding gasket receiving the board engagement ends of the plurality of contacts of the at least one wafer assembly, the grounding gasket having at least one portion in electrical contact with the at least one ground contact of the plurality of contacts, wherein the at least one ground contact of the contact wafer is in electrical contact with both the at least one conductive member and the grounding gasket, thereby defining a grounding path through the connector module, wherein the plurality of contacts of the at least one contact wafer comprise a plurality of signal contacts and a plurality of ground contacts; and the plurality of signal contacts are arranged in differential pairs wherein the differential pairs of the signal contacts and each of the plurality of ground contacts are positioned in an alternating arrangement in the at least one contact wafer, wherein the at least one conductive member is an insert having opposing sides, and each side has at least one ground contact engagement portion and at least one signal contact receiving portion, wherein each side of the at least one conductive member has a plurality of ground contact engagement portions and a plurality of signal contact receiving portions wherein each of the ground contact engagement and signal contact receiving portions alternate with respect to one another, wherein the plurality of ground contact engagement portions and the plurality of signal contact receiving portions on one side are off set from the plurality of ground contact engagement portions and the plurality of signal contact receiving portions on the other side of the at least one conductive member.

* * * * *